US006759992B2

(12) United States Patent
Knop et al.

(10) Patent No.: US 6,759,992 B2
(45) Date of Patent: Jul. 6, 2004

(54) PYRAMIDAL-CORRUGATED HORN ANTENNA FOR SECTOR COVERAGE

(75) Inventors: Charles M. Knop, Lockport, IL (US); Nabil Soliman, The Colony, TX (US); Greg Orseno, Lockport, IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/074,168

(22) Filed: Feb. 12, 2002

(65) Prior Publication Data

US 2003/0151559 A1 Aug. 14, 2003

(51) Int. Cl.[7] ..... H01Q 13/02
(52) U.S. Cl. ..... 343/786; 343/840
(58) Field of Search ..... 343/786, 840, 343/783, 781, 776

(56) References Cited

U.S. PATENT DOCUMENTS

| | | | | |
|---|---|---|---|---|
| 2,659,817 A | | 11/1953 | Cutler | 250/33 |
| 2,912,695 A | | 11/1959 | Cutler | 343/781 |
| 3,611,396 A | | 10/1971 | Jones, Jr. | 343/776 |
| 3,631,502 A | | 12/1971 | Peters, Jr. et al. | 343/786 |
| 3,924,237 A | | 12/1975 | Fletcher et al. | 343/786 |
| 4,301,456 A | | 11/1981 | Lovick, Jr. | 343/708 |
| 4,477,816 A | | 10/1984 | Cho | 343/786 |
| 4,658,258 A | * | 4/1987 | Wilson | 343/786 |

OTHER PUBLICATIONS

PROC. IEE. vol. 116. No. 2 Feb. 1969, G.H. Bryant, *Propagation in Corrugated Waveguides*, 1968.

Richard C. Johnson, *Antenna Engineering Handbook 3 rd Edition*, McGraw–Hill, Inc., New York, 1993, Ch. 15 pp. 1–54, par. 37, 45.

* cited by examiner

*Primary Examiner*—James Clinger
(74) *Attorney, Agent, or Firm*—Jenkens & Gilchrist

(57) ABSTRACT

A microwave antenna for use in a sectorized cellular communication system comprises a wide-flare pyramidal horn having two pairs of opposed flared side walls. At least one of the two pairs of opposed walls has corrugated interior surfaces. The length of the horn and the flare angle of the walls having the corrugated interior surfaces are selected to produce a ratio $\Delta_e/\lambda$ greater than 1.5, where $\Delta_e/\lambda=[a/(2/\lambda)]$ tan $(\alpha_e/2)$ is the spherical-wave error of said horn, $\lambda$ is the free space wavelength of the microwave signals to be transmitted by said antenna, $\alpha$ is the horn's aperture width, and $\alpha_e$ the half-angle of the horn in the horizontal plane.

46 Claims, 21 Drawing Sheets

PYRAMIDAL-CORRUGATED HORN ANTENNA FOR SECTOR COVERAGE

FIELD OF THE INVENTION

The present invention relates generally to sectorized cellular communication systems and, more particularly, to antennas for use in such systems.

BACKGROUND OF THE INVENTION

Pyramidal horns having corrugated interior surfaces have been known for use in microwave systems for many years.

Sectorized cellular communication systems have also been known for many years, and are in widespread commercial use. Sectorized cellular systems typically use directional antennas to separate signals radiated at similar frequencies. In theory, the antenna for each sector has a specified azimuthal beamwidth to reduce interference from both customer equipment and cell-site equipment in other cells. However, interference can increase if the antennas serving the sectors do not produce azimuth-plane patterns that drop off sharply at the edges of their respective sectors, and patterns that do not have large sidelobes and backlobes. Producing such patterns becomes more challenging as the number of sectors in a cell is increased and the sector sizes become smaller, e.g., from three 120° sectors to nine 40° sectors, or to twelve 30° sectors.

SUMMARY OF THE INVENTION

In accordance with the present invention, there is provided an antenna for use in a sectorized cellular communication system, the antenna comprising a wide-flare pyramidal horn having two pairs of opposed flared side walls, at least one of the two pairs of opposed walls having corrugated interior surfaces, the length of the horn and the flare angle of the walls having the corrugated interior surfaces being selected to produce a ratio $\Delta_e/\lambda$ greater than 1.5, where $\Delta_e=[a/2/\lambda]\tan(\alpha_e/2)$ is the spherical-wave error of said horn, $\lambda$ is the free space wavelength of the microwave signals to be transmitted by said antenna, a is the aperture width and $\alpha_e$ is the horizontal half-angle of the horn.

The azimuthal pattern has a half-power beam width that is substantially as wide as the azimuthal width of the specified sector and drops sharply at both azimuthal edges of that sector. In the elevation plane, The elevation pattern is substantially free of nulls across a specified elevation-plane beam width (typically ±25°).

When used in a sectorized cellular communication system, this antenna is capable of producing specified patterns in both the azimuth and elevation planes of a specified azimuthal sector with a specified ground range within a cell.

BRIEF DESCRIPTION OF THE DRAWINGS

The invention may best be understood by reference to the following description taken in conjunction with the accompanying drawings, in which.

DETAILED DESCRIPTION OF THE PREFERRED EMBODIMENTS

Although the invention will be described in connection with certain preferred embodiments, it will be understood that the invention is not limited to those particular embodiments. On the contrary, the invention is intended to include all alternatives, modifications and equivalent arrangements as may be included within the spirit and scope of the invention as defined by the appended claims.

Figure 1:
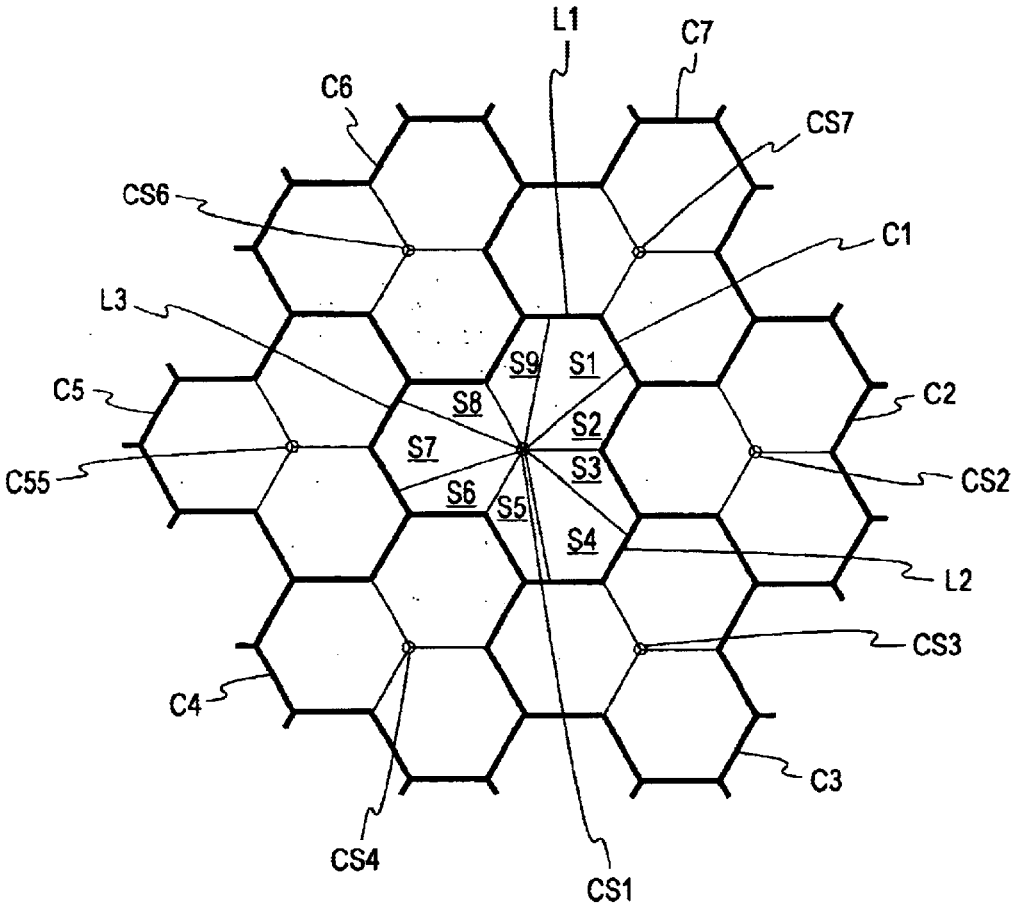
FIG. 1 is a diagrammatic illustration of a sectorized cellular communication system.
Figure 2:
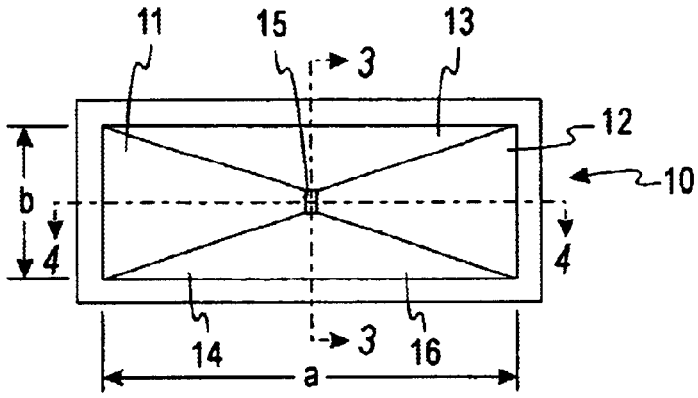
FIG. 2 is an end elevation of a pyramidal horn antenna for use in the system of FIG. 1.
Figure 3:
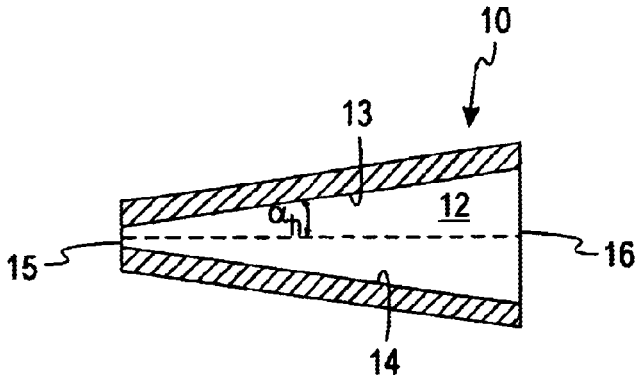
FIG. 3 is a section taken along line 3—3 in FIG. 2.

FIG. 1 illustrates a portion of a sectorized cellular communication system having multiple cells C1, C2, C3 . . . Cn containing respective cell sites CS1, CS2, CS3 . . . CSn.

Each cell site contains antennas for transmitting signals to, and receiving signals from, multiple sectors S within each cell C. In the particular system illustrated in FIG. 1, the cell C1 is surrounded by six similar cells C2–C7, and each cell has nine sectors S1–S9. The cell C1 comprises three corner-excited hexagonal lobes L1, L2 and L3, each containing three of the nine sectors. The nine 40° sectors S1–S9 radiate from the center of the cell C1 where a cell site CS1 is located. Each cell site CS includes an antenna mast, as well as the electronic equipment for processing the signals transmitted to, and received from, the various customer units (typically mobile units) within that cell.

Directional antennas are typically used in a sectorized cellular system to separate signals radiated at similar frequencies. For example, in the illustrative system of FIG. 1, the antenna for each sector would have a nominal 40° azimuthal beamwidth to reduce interference from both customer equipment and cell site equipment in other cells. However, interference can increase if the antennas serving the sectors do not produce azimuth-plane patterns that drop off sharply at the edges of their respective sectors, and patterns that do not have large sidelobes and backlobes. Producing such patterns becomes more challenging as the number of sectors in a cell is increased and the sector sizes become smaller, e.g., from three 120° sectors to nine 40° sectors, or to twelve 30° sectors.

Figure 4:
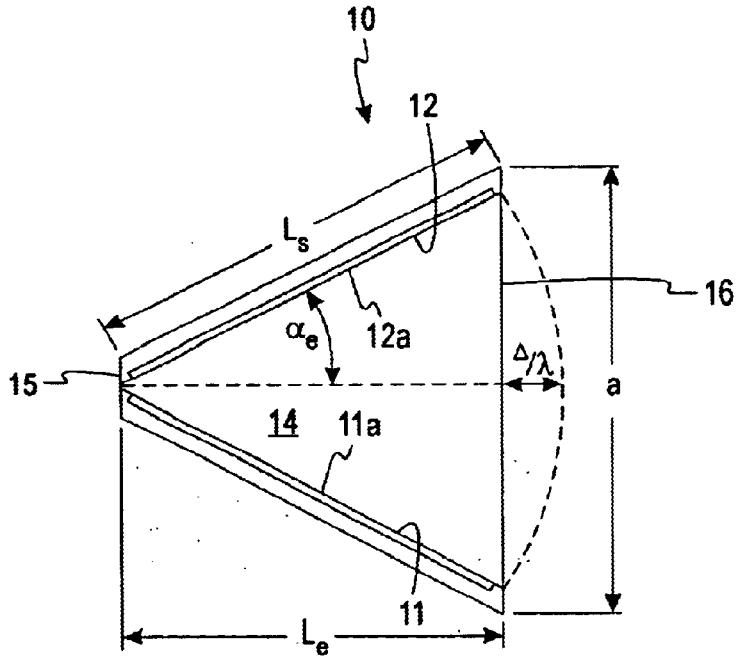
FIG. 4 is a diagrammatic section taken along line 4—4 in FIG. 2.

In accordance with one aspect of the present invention, the antenna used in the sectorized cellular communication system comprises a wide-flare pyramidal horn having two pairs of opposed flared side walls, at least one of the two pairs of opposed walls having corrugated interior surfaces, and the length of the horn and the flare angle of the walls having the corrugated interior surfaces being selected to produce a normalized spherical-wave error $\Delta/\lambda$ greater than one. As a wave propagates toward the wide end of the horn 10, the central portion of the wave moves ahead of the edge portions, producing a spherical wave front at the horn aperture, as illustrated in FIG. 4. The path difference $\Delta$ between the spherical wavefront and an ideal plane wave at the horn aperture is referred to as the spherical-wave error or path error. The normalized spherical-wave error (in wavelengths) is $\Delta/\lambda$, where $\lambda$ is the free space wavelength of the signals to be transmitted by said antenna. In the E plane, the normalized spherical-wave error is $\Delta_e/\lambda$ and is equal to: $[a/(2\lambda)]\tan(\alpha_e/2)$. (For a sufficiently large phase error (e.g., $\Delta_e/\lambda \geqq ½$), the E-plane patterns (in the 0 to 3 dB-down region) produced by the corrugated horn are largely insensitive to the operating frequency.

One example of such an antenna is the pyramidal horn 10 illustrated in FIGS. 2–4*a*. This horn 10 has a generally rectangular cross-section formed by narrow side walls 11 and 12 flared at an angle $\alpha_e$ and wide top and bottom walls 13 and 14 flared at an angle $\alpha_h$. The horn has an axial length $L_e$ and a slant length $L_s$. The small end 15 of the horn 10 is typically connected to a rectangular waveguide or other transmission line through which microwave signals are transmitted to and from the horn 10. This small end 15 of the horn forms a rectangular opening having the same dimensions as the interior of the rectangular waveguide (not shown) connected to the horn. The large end 16 of the horn 10 forms the antenna aperture through which the microwave signals are radiated into, and received from, the free space beyond the aperture.

Figure 4A:
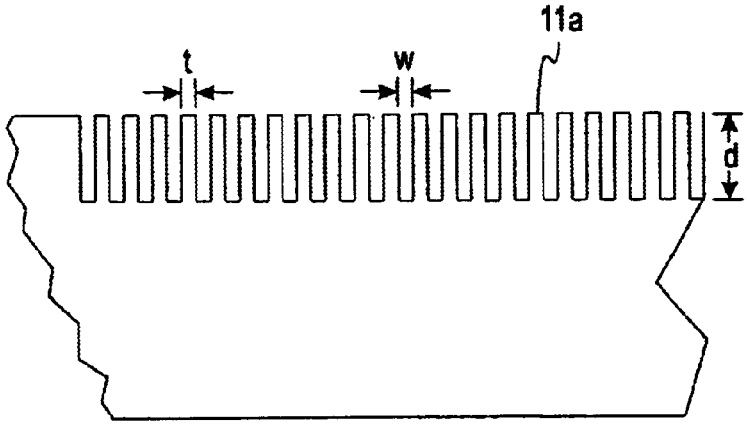
FIG. 4*a* is an enlarged portion of one of the corrugated walls shown in FIG. 4.

The illustrative horn 10 shown in FIGS. 2–4*a* is designed for horizontally polarized signals. Thus, the wide dimension a of the aperture is parallel to the E plane, i.e., the horizontal or azimuth plane, and the narrow dimension b is parallel to the H plane, i.e., the vertical or elevation plane. The side walls 11 and 12 both have corrugated inside surfaces 11*a* and 12*a*, with the corrugations beginning near the small end 15 of the horn. The corrugations are preferably formed perpendicular to the horn wall rather than the horn axis. As illustrated in FIG. 4*a*, each corrugation has a depth d, a trough width w, and a crest width t. A vertically polarized version of this antenna would have the top and bottom walls 13 and 14 corrugated.

In keeping with the present invention, the length of the horn and the flare angle $\alpha_e$ of the corrugated walls are selected to produce a normalized path error $\Delta_e/\lambda$ greater than 1.5, preferably greater than 2, and most preferably greater than 2.5. As seen from FIG. 5 (discussed below), this high $\Delta_e/\lambda$ ratio causes the far-field, azimuth-plane pattern of the horn to drop off sharply below the 3-dB points in the E plane, thus providing good coverage across the azimuthal width of the specified sector with very little interference in adjacent sectors. The azimuthal pattern has a half-power beam width that is substantially as wide as the azimuthal width of the selected sector and drops sharply at both azimuthal edges of that sector.

In the elevation plane (here the H-plane), the normalized path error $\Delta_h/\lambda$ should be greater than about 0.25 to produce an elevation-plane pattern that is substantially free of nulls within the specified ground range. Thus, the half angle of the horn need not be as large in this plane as in the azimuth plane.

Figure 5:
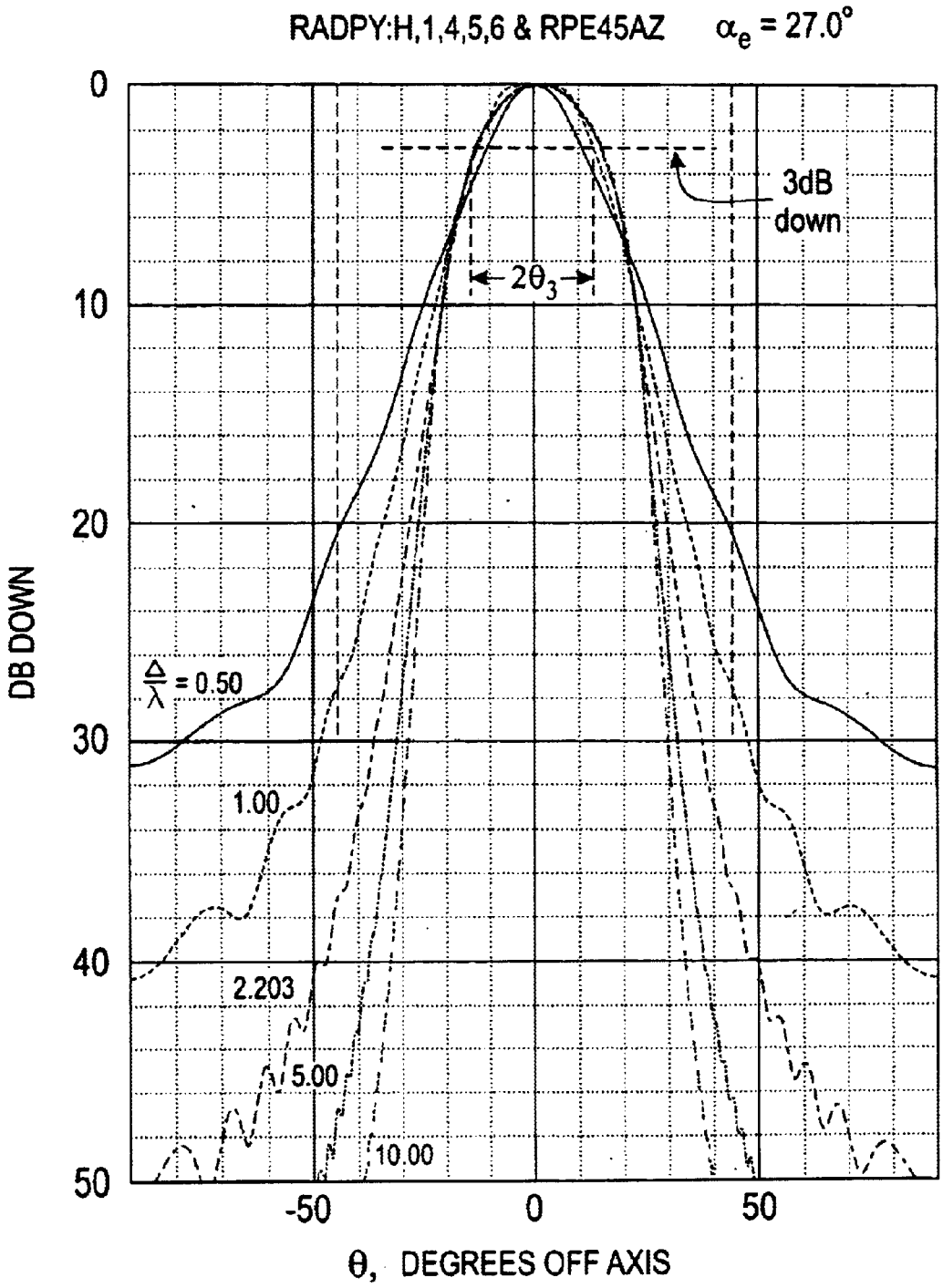
FIG. 5 is a family of azimuth-plane patterns for a pyramidal horn antenna of the type shown in FIGS. 2–4*a* modified to have different ratios $\Delta_e/\lambda$ for a constant half-angle, $\alpha_e$=27.0°.
Figure 6A:
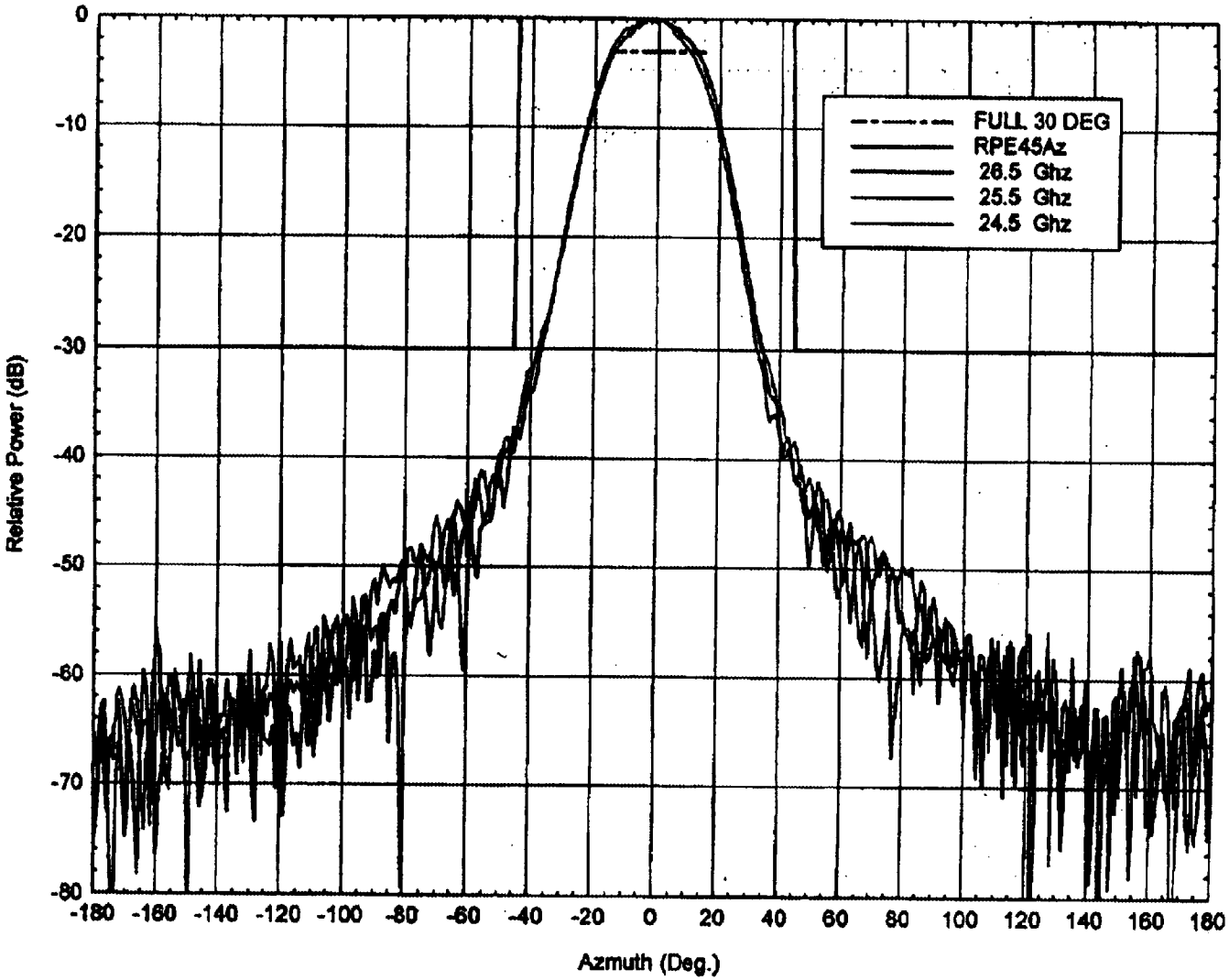
FIG. 6*a* is a set of measured co-polar azimuth-plane radiation patterns produced by a 30° sector horizontally polarized horn antenna tested at frequencies of 24.5, 25.5 and 26.5 GHz.
Figure 6B:
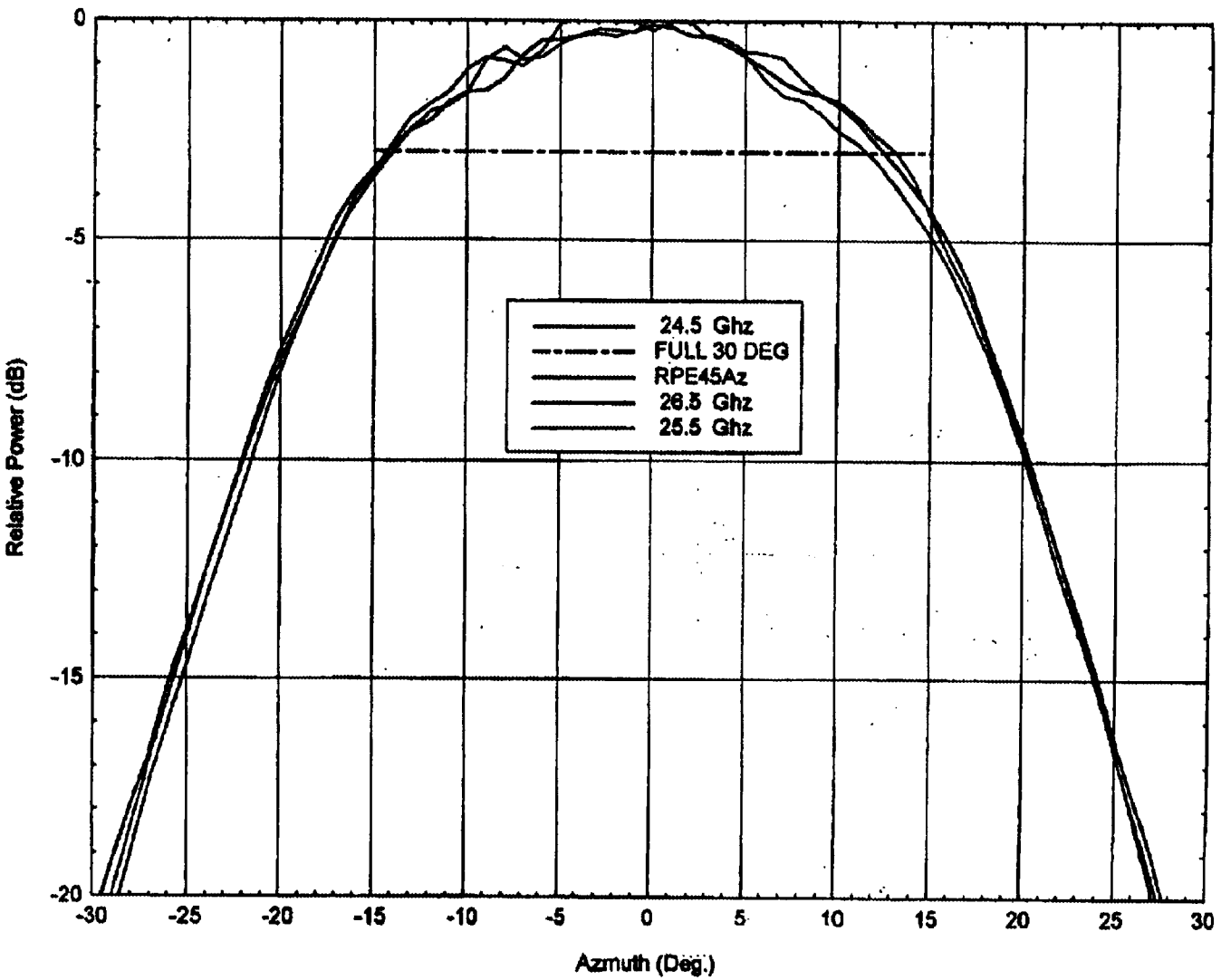
FIG. 6*b* is an enlarged view of the ±30° region of the patterns of FIG. 6*a;*
Figure 6C:
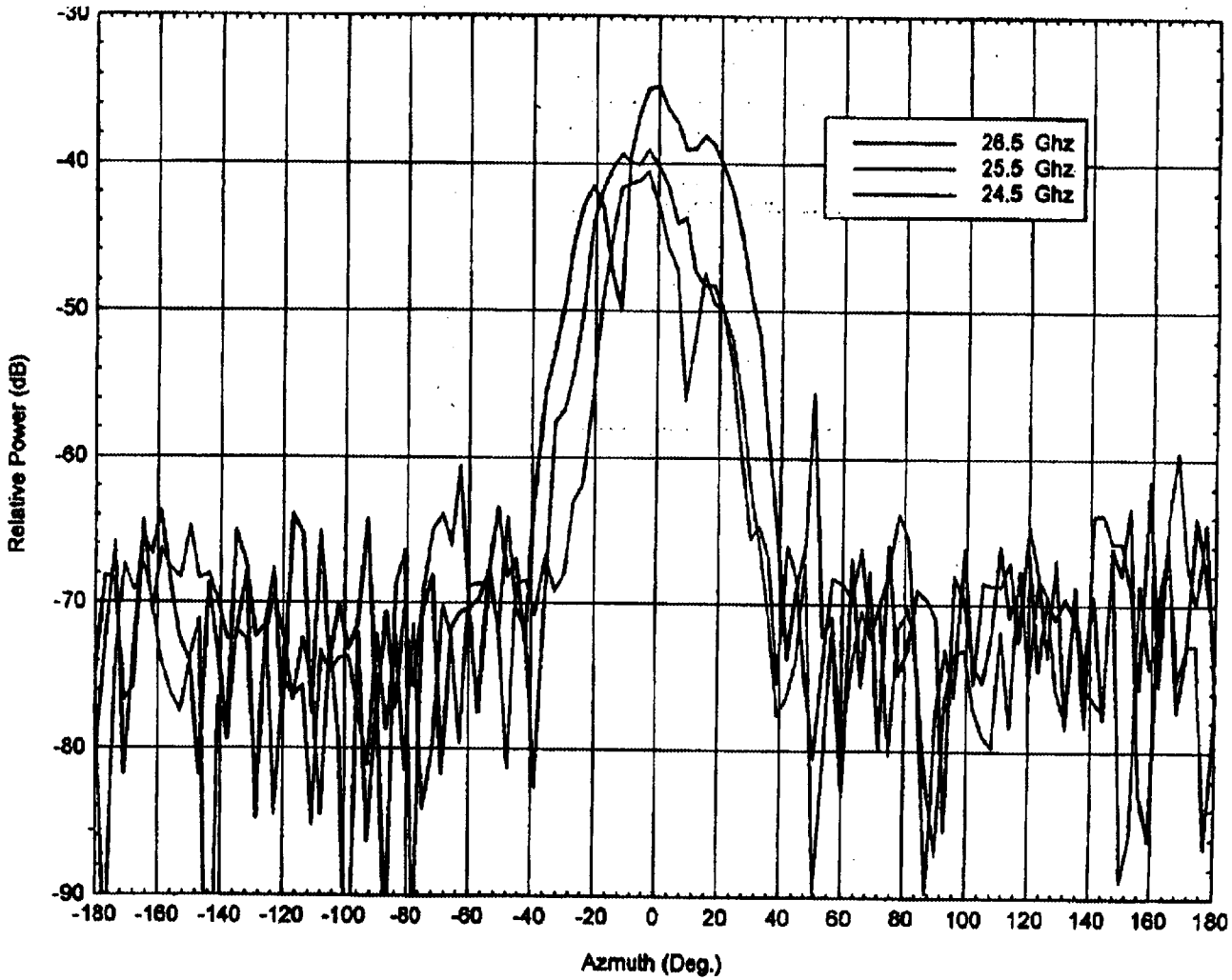
FIG. 6*c* is a set of measured cross-polar azimuth-plane patterns produced by the same antenna that produced the patterns of FIG. 6*a;*
Figure 6D:
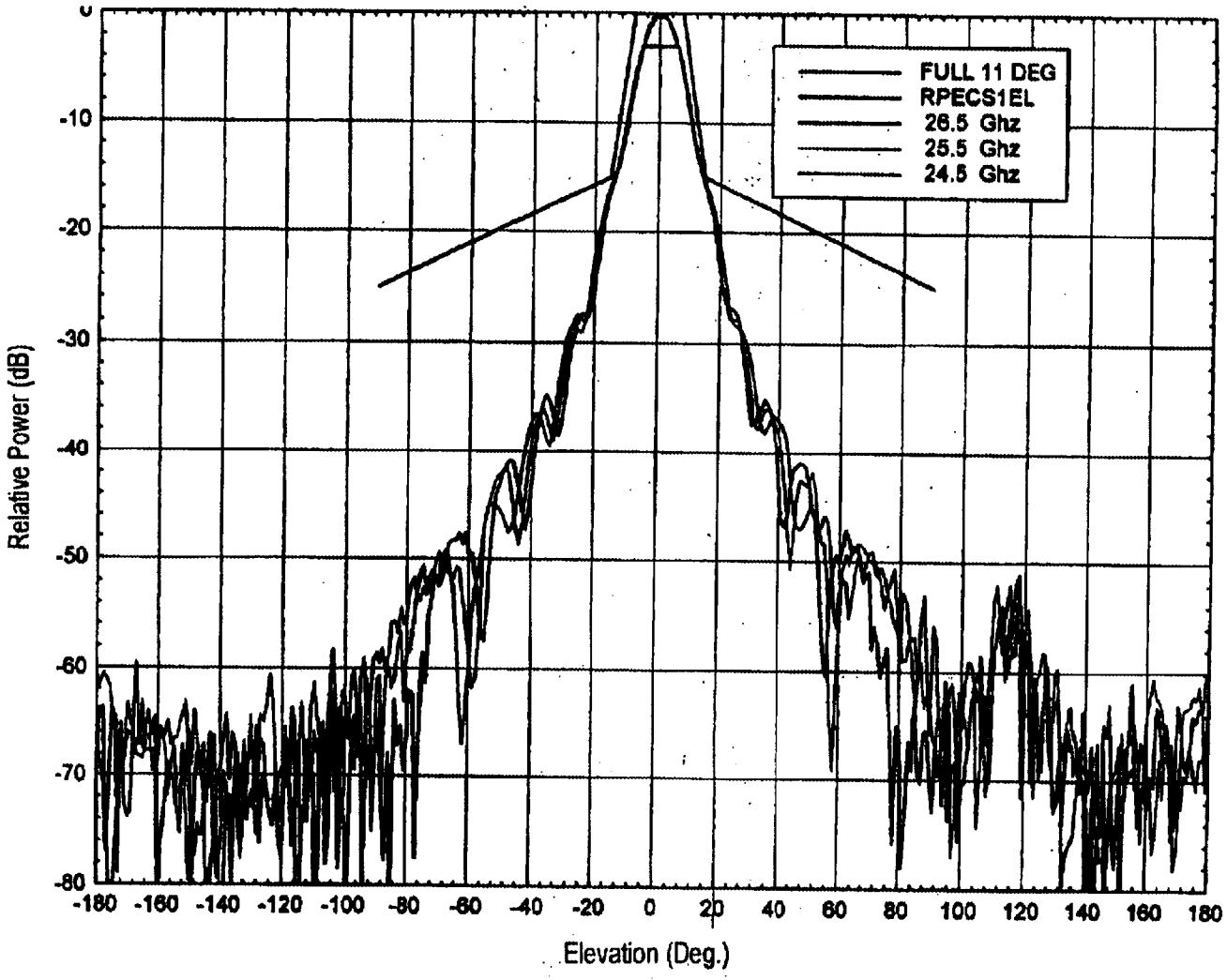
FIG. 6*d* is a set of measured co-polar elevation-plane radiation patterns produced by the same antenna that produced the patterns of FIG. 6*a;*
Figure 6E:
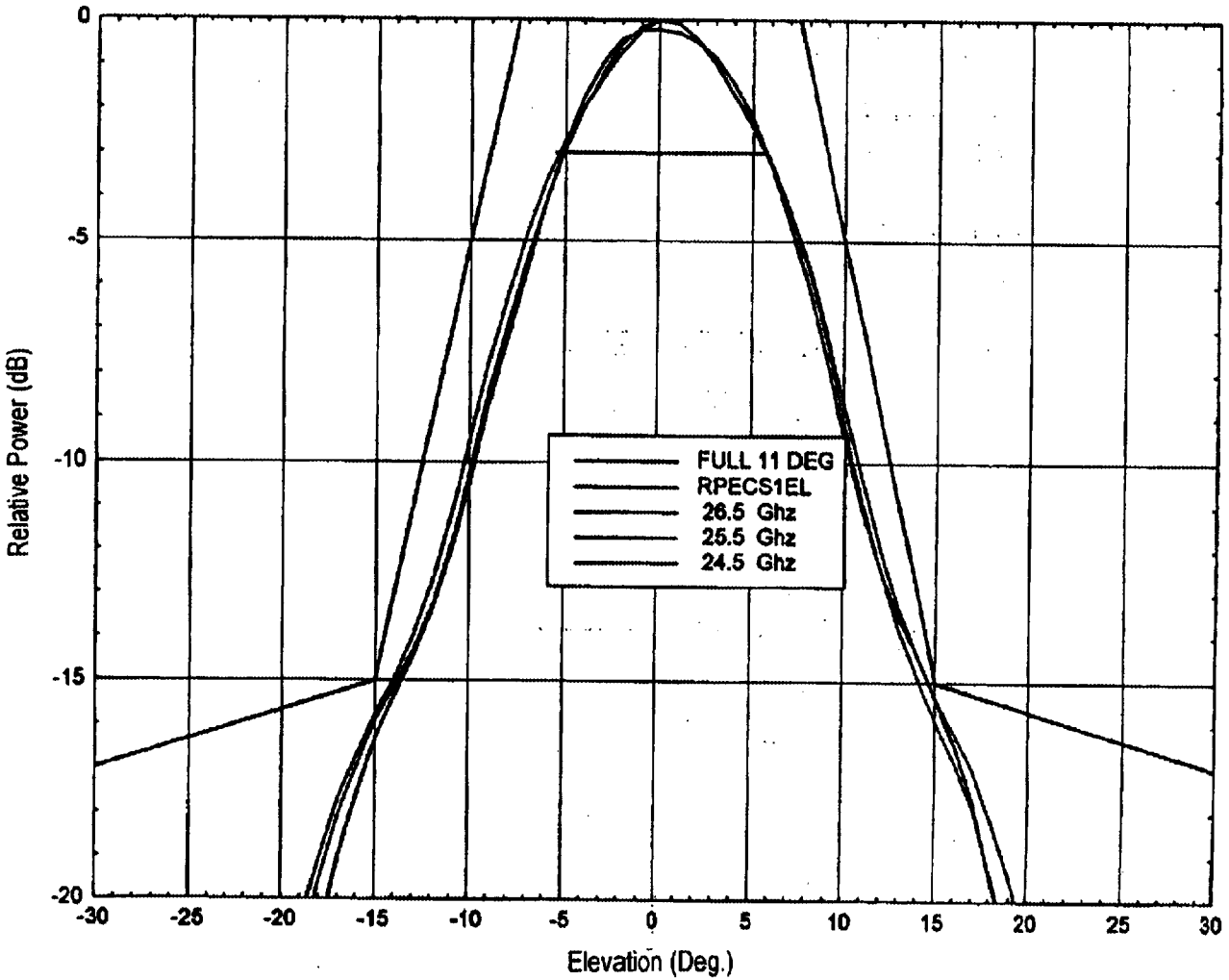
FIG. 6*e* is an enlarged view of the ±30° region of the patterns of FIG. 6*d;*
Figure 6F:
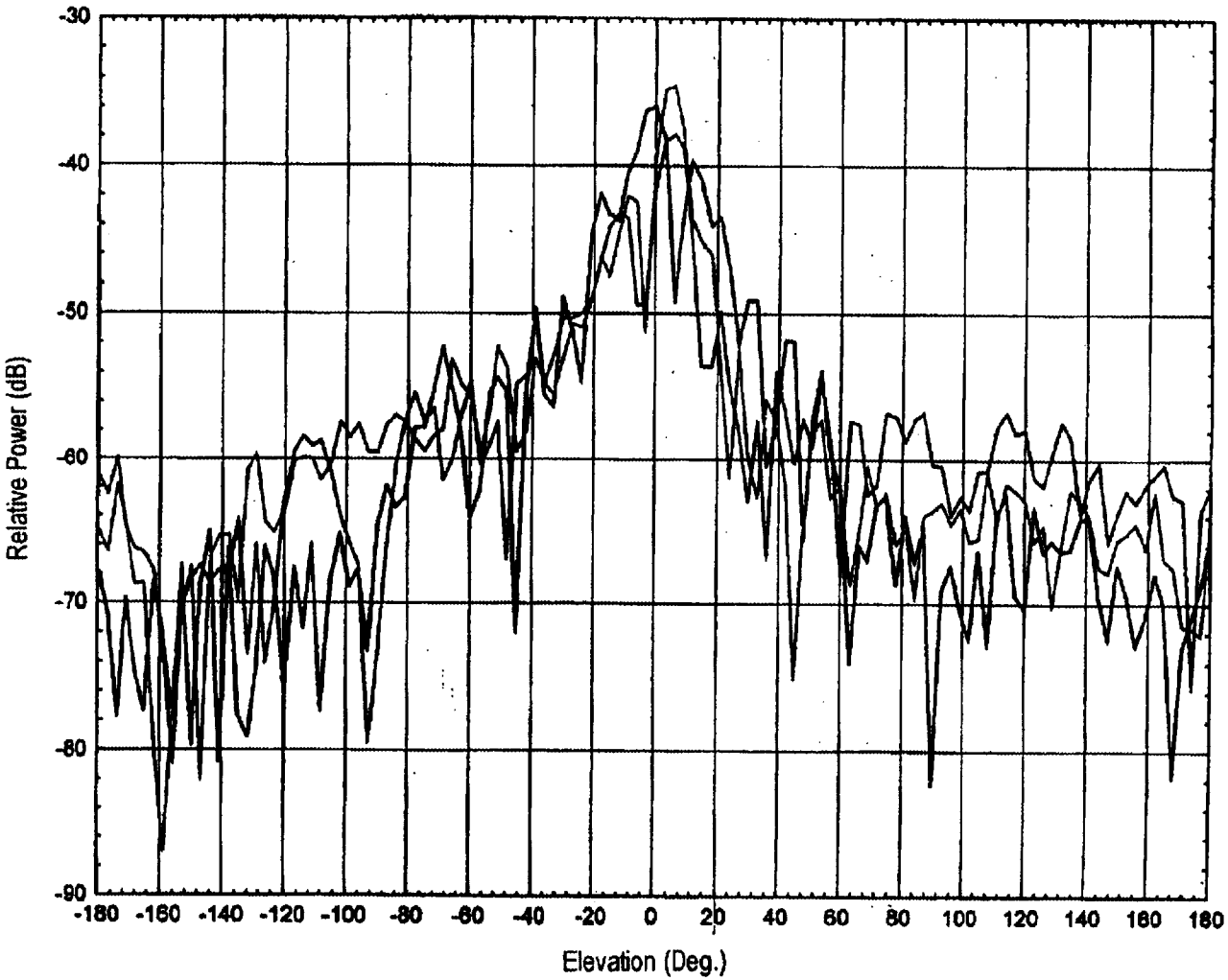
FIG. 6*f* is a set of measured cross-polar elevation-plane patterns produced by the same antenna that produced the patterns of FIG. 6*a;*
Figure 7A:
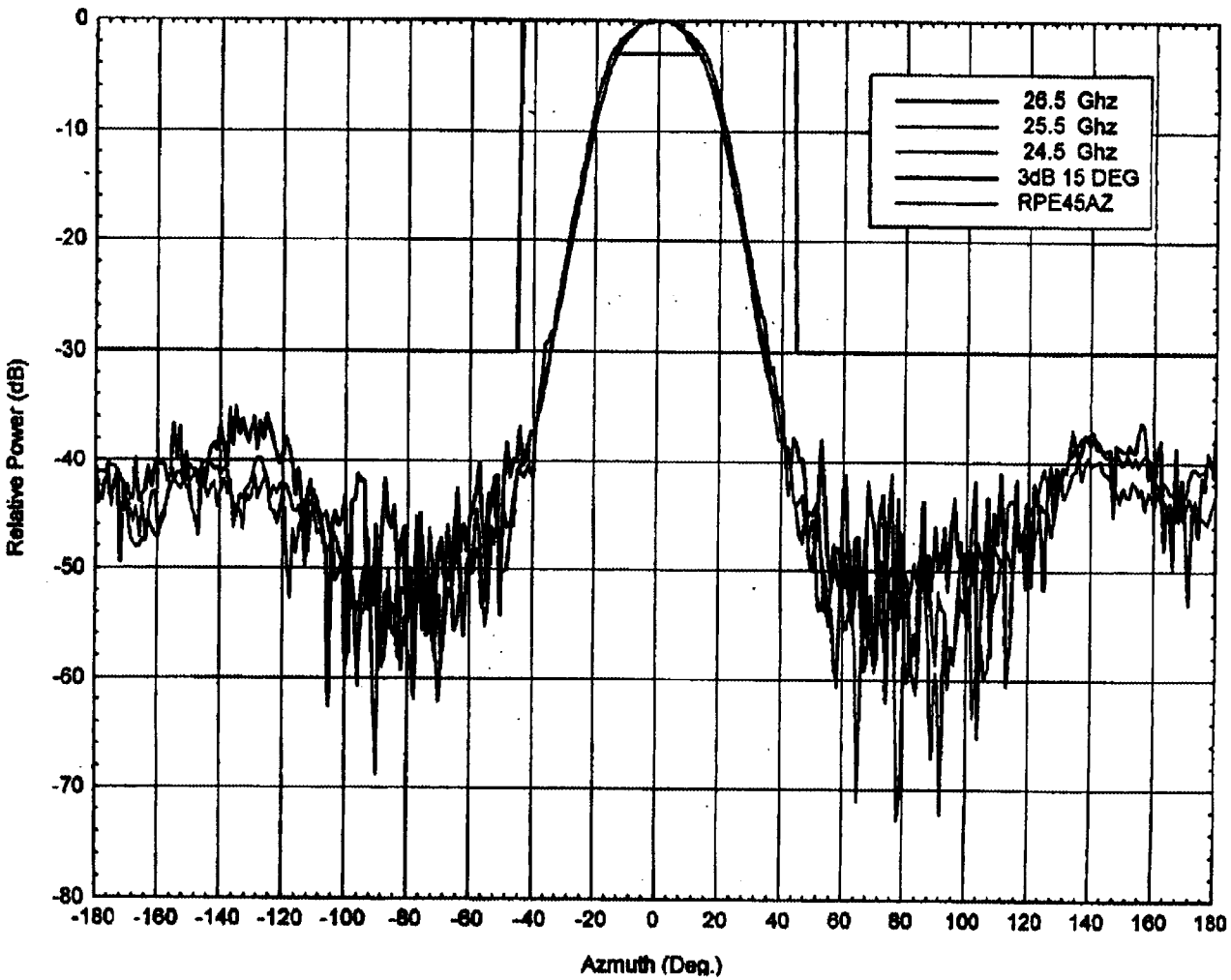
FIG. 7*a* is a set of measured co-polar azimuth-plane radiation patterns produced by a 30° sector vertically polarized horn antenna tested at frequencies of 24.5, 25.5 and 26.5 GHz.
Figure 7B:
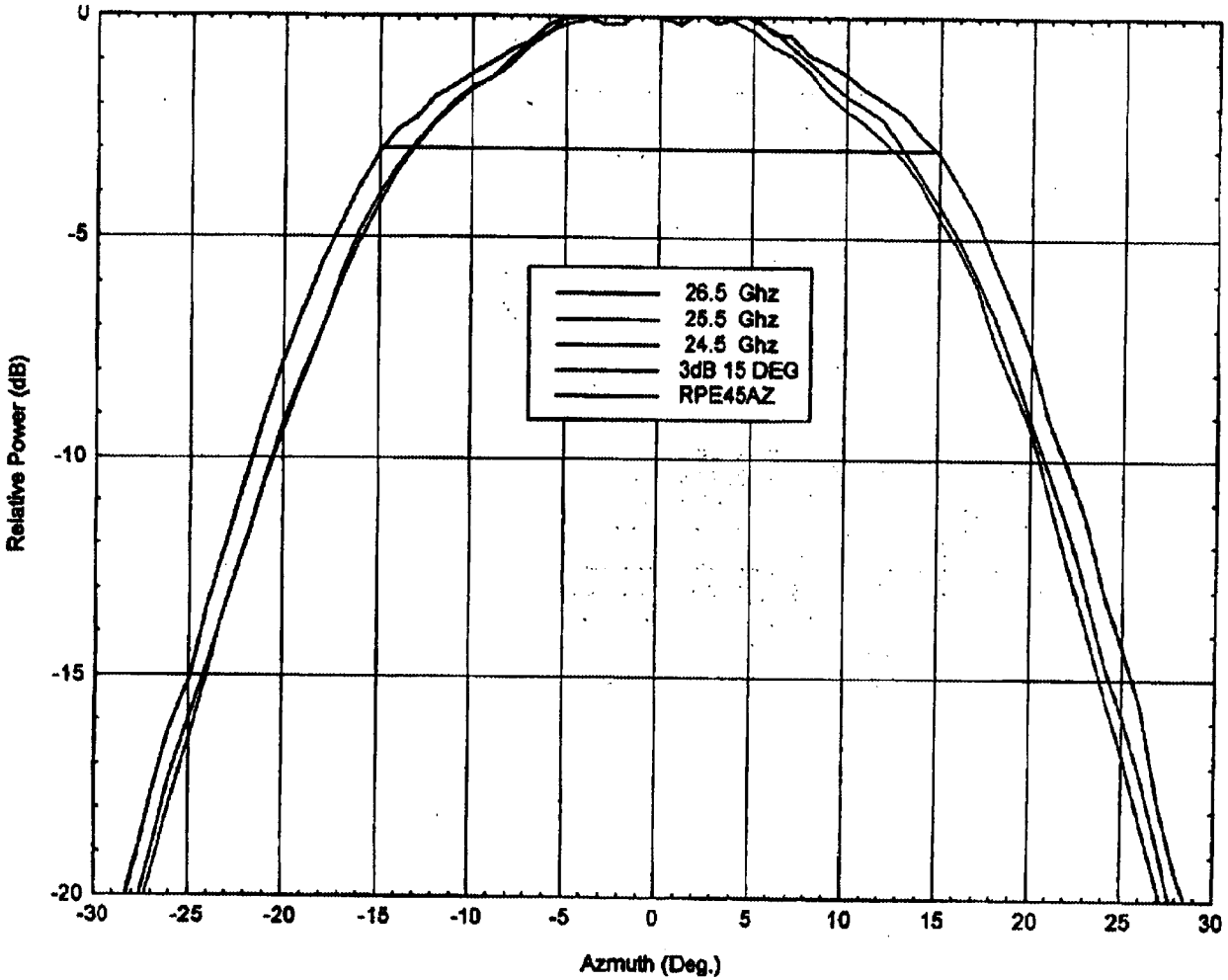
FIG. 7*b* is an enlarged view of the 0–20 dB region of the patterns of FIG. 7*a;*
Figure 7C:
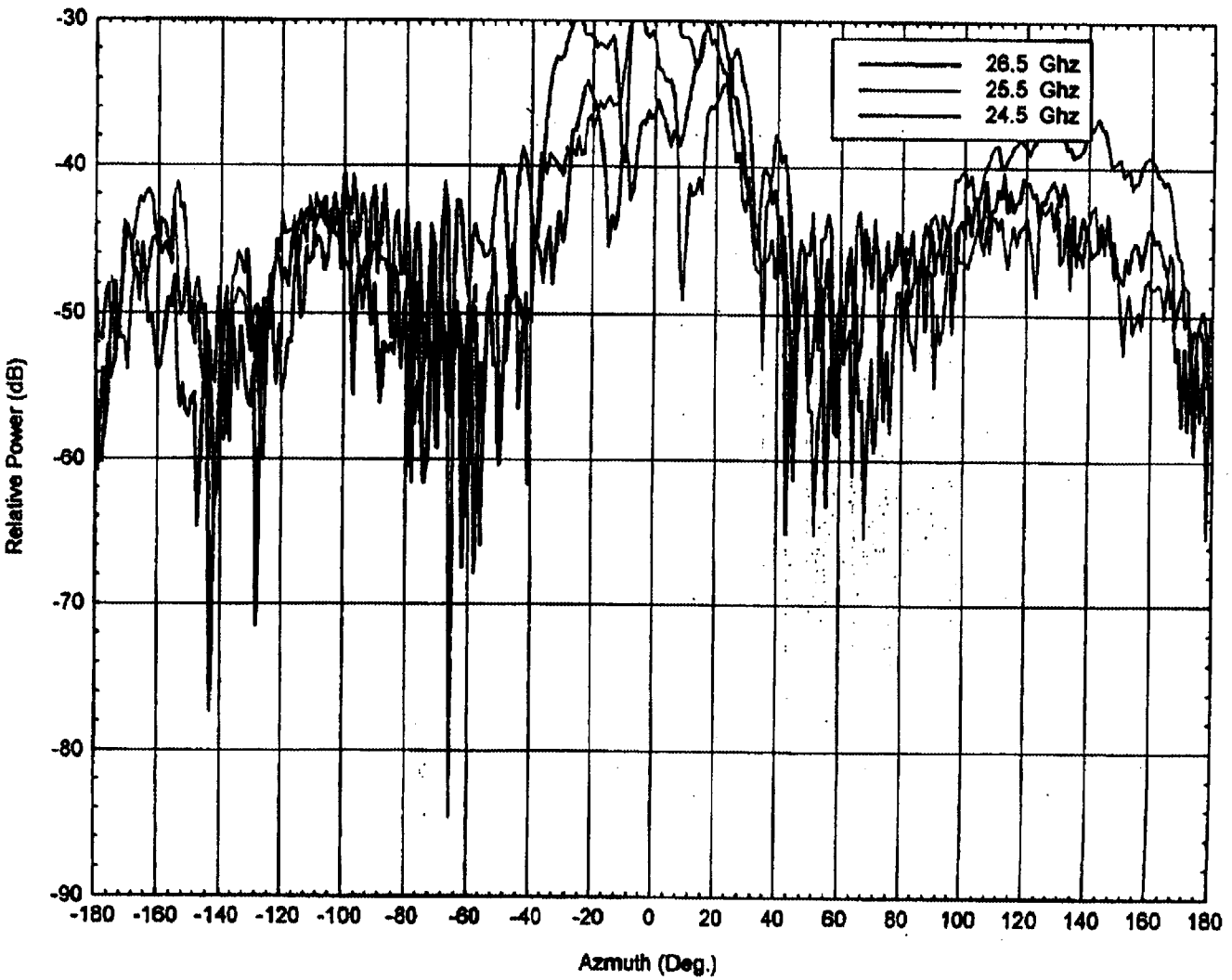
FIG. 7*c* is a set of measured cross-polar azimuth-plane patterns produced by the same antenna that produced the patterns of FIG. 7*a;*
Figure 7D:
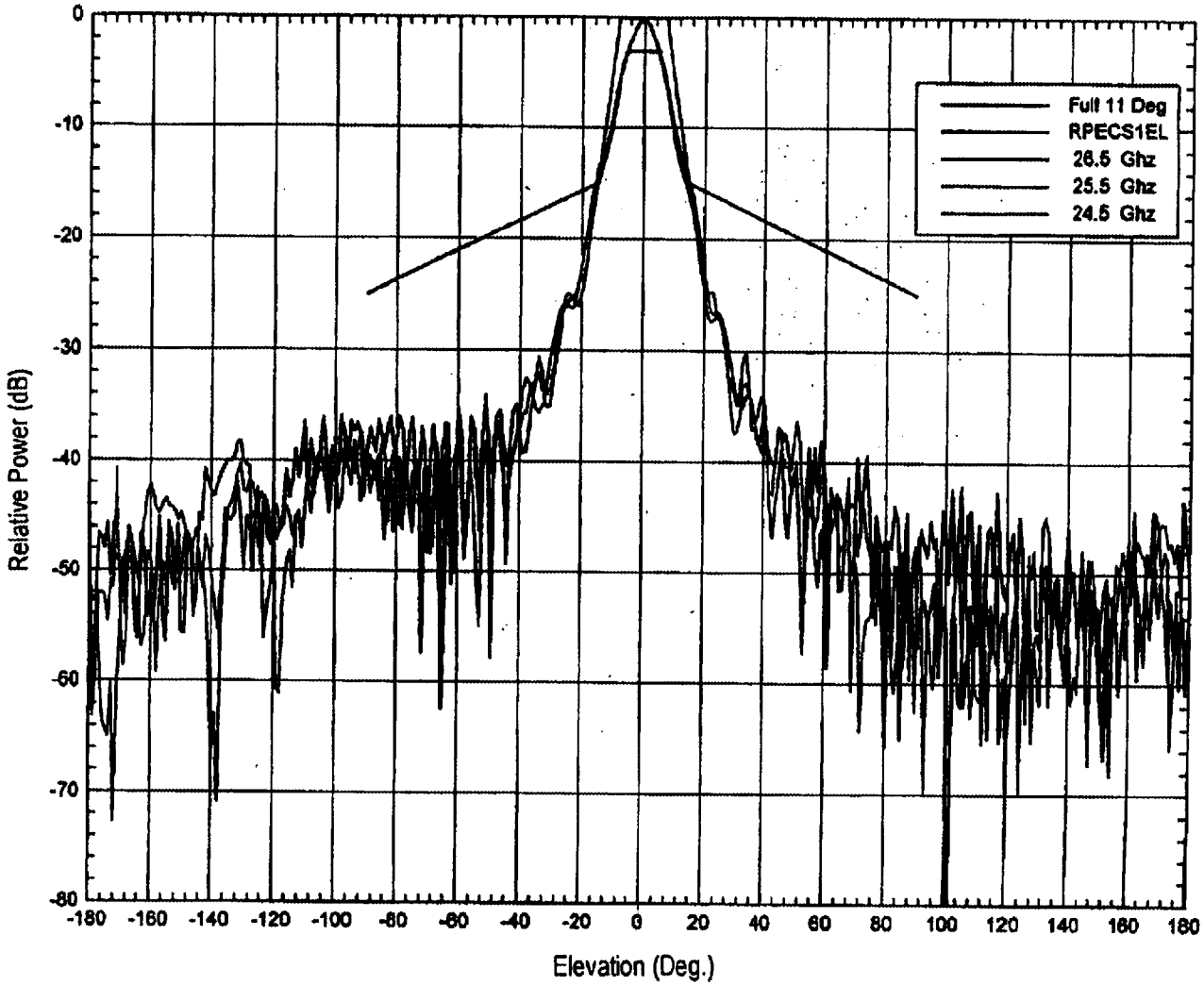
FIG. 7*d* is a set of measured co-polar elevation-plane radiation patterns produced by the same antenna that produced the patterns of FIG. 7*a;*
Figure 7E:
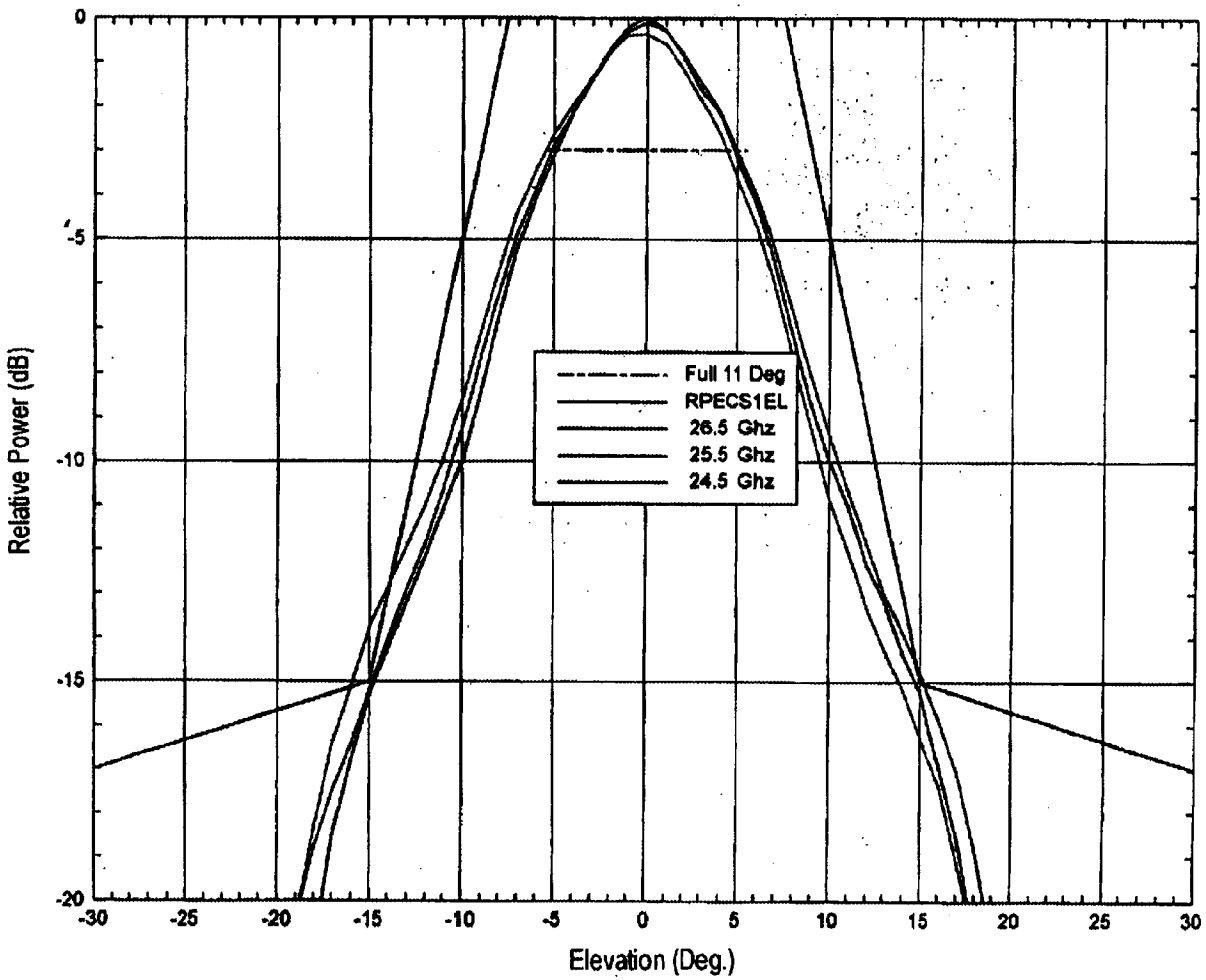
FIG. 7*e* is an enlarged view of the 0–20 dB region of the patterns of FIG. 7*d;*
Figure 7F:
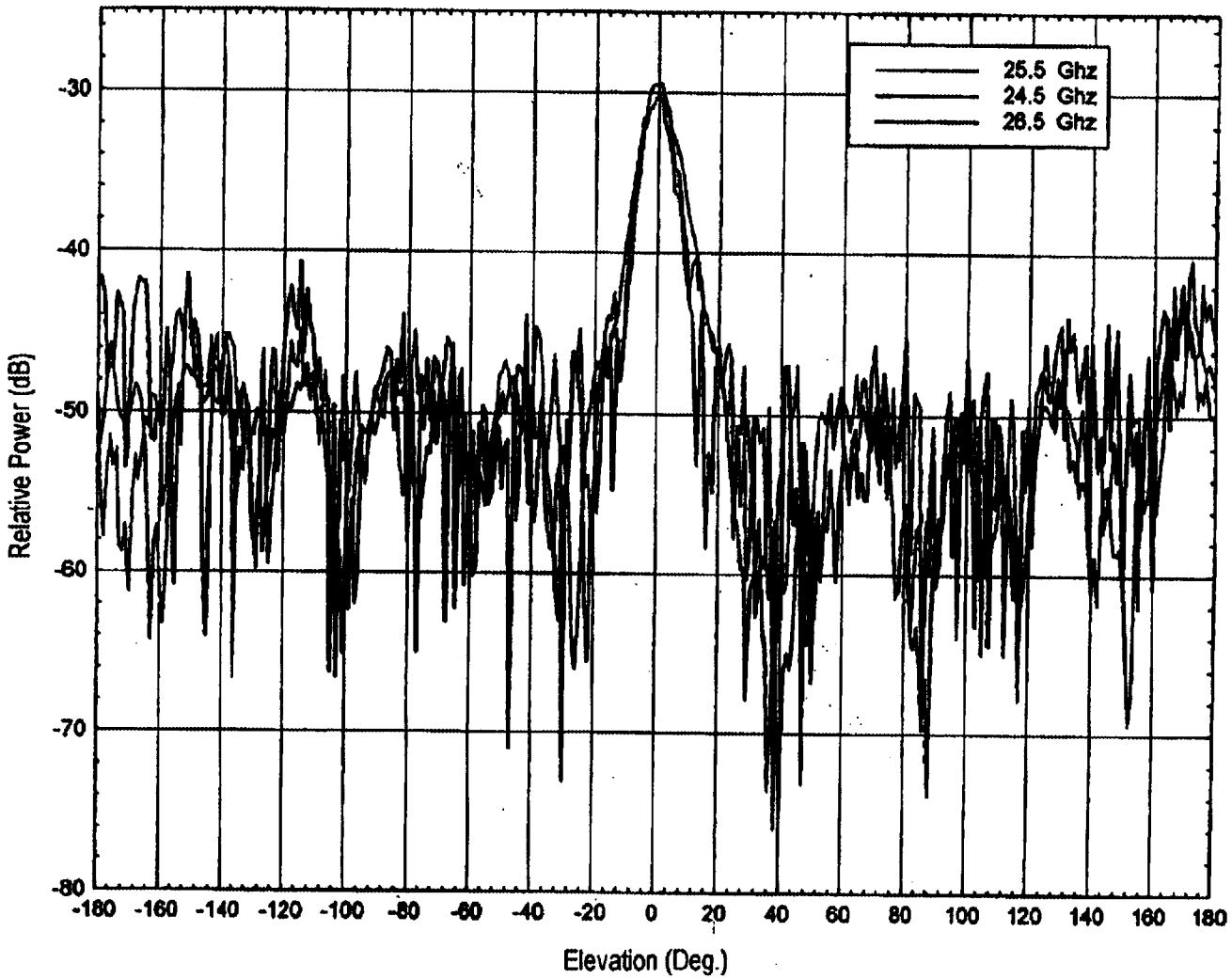
FIG. 7*f* is a set of measured cross-polar elevation-plane patterns produced by the same antenna that produced the patterns of FIG. 7*a;*

FIG. 5 is a family of azimuth-plane patterns for a pyramidal horn antenna of the type $\Delta_e/\lambda$ shown in FIGS. 2–4*a* having a half-angle of $\alpha_e$=27.0° and of various widths $a/\lambda$ so as to produce corresponding various values of $\Delta_e/\lambda$. It can be seen that when the ratio has a value greater than about 1.5, the pattern maintains the desired 3 dB beamwidth while the edges of the pattern drop off more and more sharply as the ratio increases. Moreover, this desirable pattern is maintained over a wide bandwidth.

FIGS. 6*a*–6*f* are measured patterns produced by a horn of the type of FIGS. 2–5 corresponding to $\Delta_e/\lambda$=2.203 to produce a 30° sector horizontally polarized horn antenna at frequencies of 24.5, 25.5 and 26.5 GHz. FIGS. 7*a*–7*f* are similar measured patterns produced by a 30° sector vertically polarized horn antenna tested at frequencies of 24.5, 25.5 and 26.5 GHz. Both horns had a WR-42 input (0.420"× 0.170" opening at the small end) with a 8.5"-wide×3.0"-high opening at the large end. For both horns the narrow side walls tapered at an angle of $\alpha_e$=27°, and the wide top and bottom walls tapered at an angle of $\alpha_h$=8.97° for the horizontally polarized horn and 10.12° for the vertically polarized, where the former had an axial length of 8.174" and the latter 7.929." In the horizontally polarized horn, the wide input sides were parallel with the narrow side walls of the WR-42, and were corrugated, beginning at 0.3" from the WR-42 input, with flat rectangular corrugations having a uniform depth d of 0.14" and uniform widths w and t of 0.025" for both the troughs and the crests. In the vertically polarized horn, the wide side of the WR-42 input was parallel with the wide top and bottom walls of the horn, which were corrugated in the same manner, beginning at 0.4" from the input.

It can be seen from the measured patterns in FIGS. 6*a*–*f* and 7*a*–*f* that, over the 24.5 to 26.5 GHz frequency range, the azimuth-plane patterns have a 30° 3-dB beamwidth, and the patterns drop off sharply to about −10 dB at ±20°, about −20 dB at ±30°, about −30 dB at ±35°, and about −40 dB at ±45°. The elevation-plane patterns have a 3-dB beamwidth of about 11°. The worst cross-pol is about −30 dB. The worst case return loss is −16.2 dB (at the low end). The gains were measured by comparison (against a WR-42 standard gain horn of 24.5 dBi), with the following results:

| f, GHz | Gain, dBi |
|---|---|
| 24.5 | 21.2 |
| 25.5 | 21.0 |
| 26.5 | 21.4 |

A horn antenna of the type described above is designed to have a specified half-power beamwidth and a specified sharp sector coverage. A set of complete radiation patterns may be obtained by exact numerical integration of the aperture fields in a horn having a fixed half angle and varying $\Delta/\lambda$. The integration of the aperture fields is preferably carried out numerically with no approximations with respect to the phase distribution of the fields in the aperture of the horn. The curve that best satisfies both the specified half-power beamwidth and the specified sector coverage is then selected, and that curve is used to determine the flare angle and length of the horn, using the previously given relationship of: $\Delta_e/\lambda=[a/(2\lambda)]\tan(\alpha_e/2)$ to solve for $a/\lambda$ once the choice of $\Delta_e/\lambda$ is made for the given $\alpha_e$ value considered.

Figure 8:
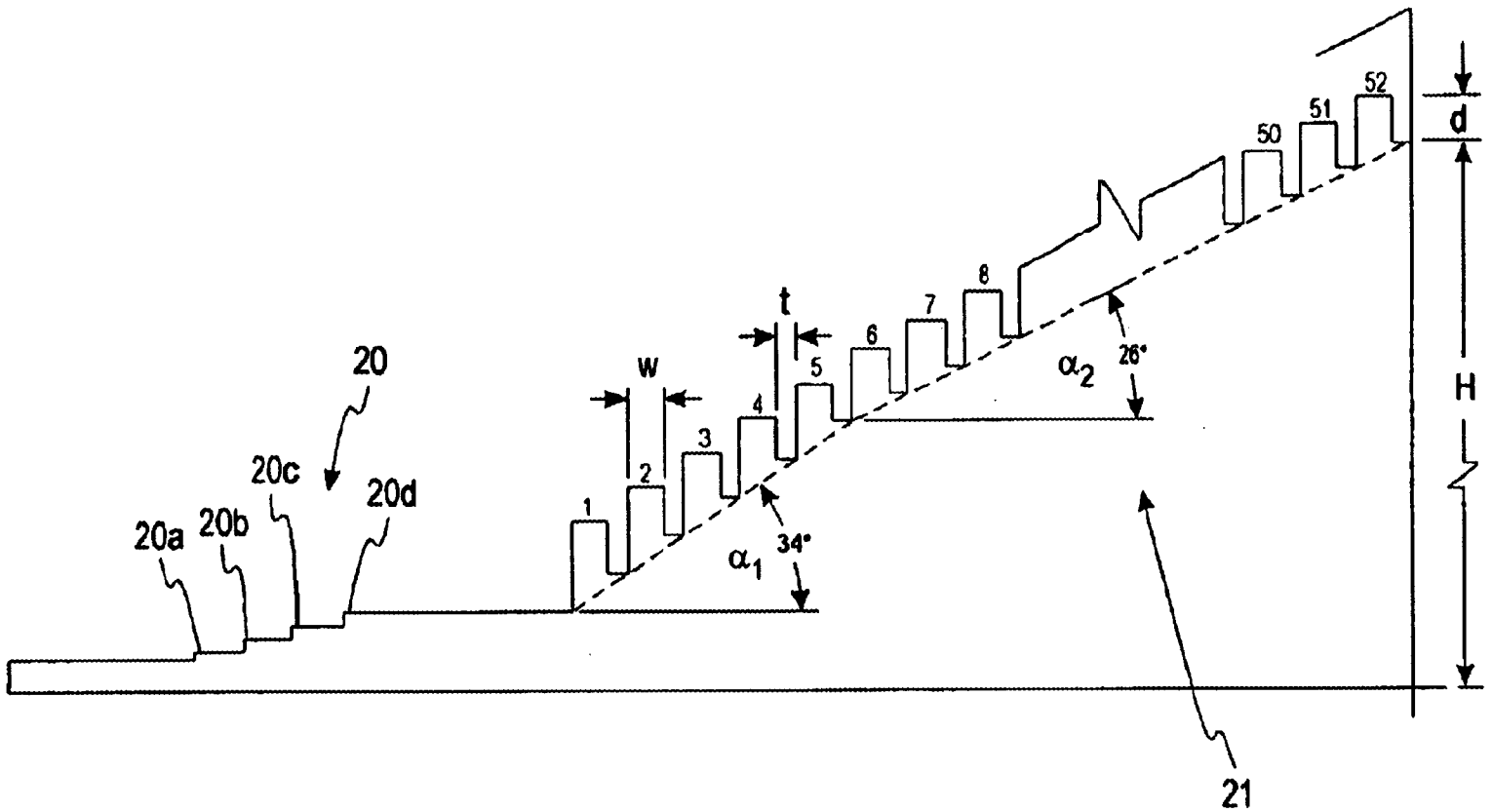
FIG. 8 is a longitudinal profile of the interior surface of one of a symmetrical pair of opposed walls in a modified pyramidal horn antenna embodying the present invention.
Figure 9A:
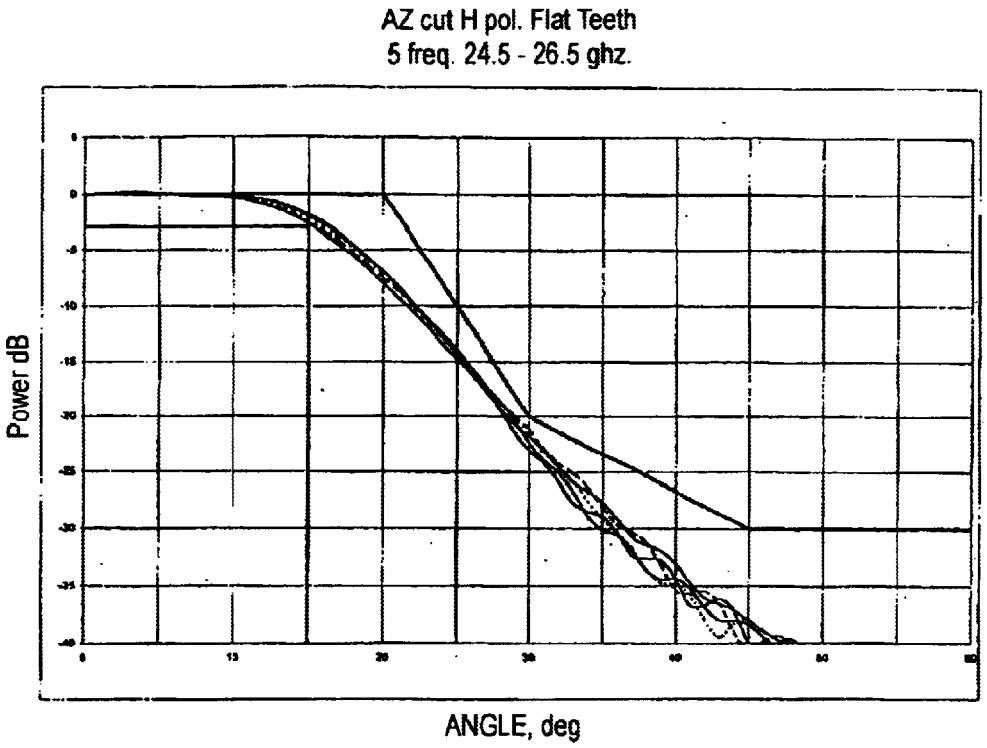
FIGS. 9*a* and 9*b* are predicted azimuth-plane and elevation-plane patterns, respectively, produced by the horn antenna of FIG. 8.
Figure 9B:
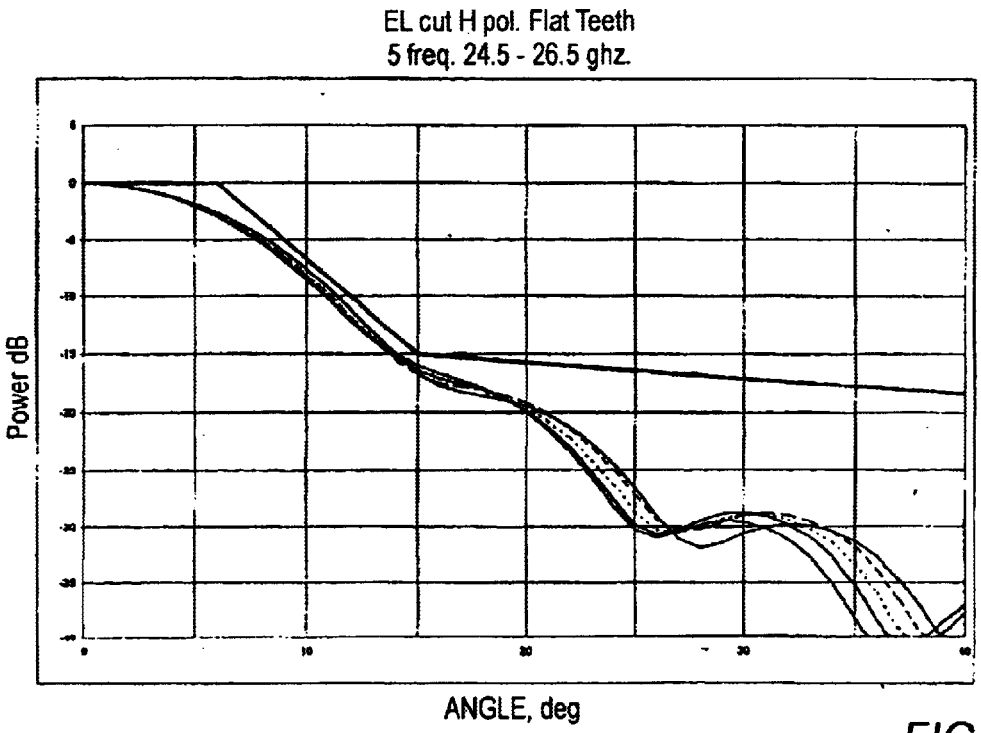

Once a choice of $\Delta_e/\lambda$ is made for a given $\alpha_e$, as above, an improved design (both in patterns and return loss) can be obtained using a computer-generated pyramidal horn. For example, FIG. 8 is a longitudinal profile of the interior surface of one of a symmetrical pair of opposed walls in a computer-optimally designed pyramidal horn antenna used to produce the same type of azimuth-plane and elevation-plane patterns shown in FIGS. 9*a* and 9*b*. It can be seen that the wall 20 of the rectangular waveguide feeding the horn 21 is stepped at the small end of the horn, forming a series of steps 20*a–d* that progressively increase the transverse dimension of the horn to match the size of the opening at the small end of the horn 21. Beginning at the small end of the stepped transition, the axial distances between steps are 0.128, 0.137, 0.138 and 0.610 inch, respectively, and the transverse distance from the axis increases progressively from 0.085 to 0.104 to 0.138 to 0.172 to 0.210 inch, respectively. These steps in the waveguide wall improve the VSWR (return loss) matching. The horn wall is corrugated continuously along the entire length of the horn, with corrugations having the following dimensions:

| Corrugation No. | Depth d | Trough Width w | Crest Width t |
|---|---|---|---|
| 1 | 0.24 | 0.10 | 0.05 |
| 2 | 0.23 | 0.10 | 0.05 |
| 3 | 0.22 | 0.10 | 0.05 |
| 4 | 0.21 | 0.10 | 0.05 |
| 5 | 0.20 | 0.10 | 0.05 |
| 6 through n | 0.19 | 0.10 | 0.05 |

The troughs of all the corrugations have flat bottom surfaces, parallel to the horn axis. The azimuth and elevation aperture dimensions are 8.3" by 2.6", respectively. The return loss was 32 dB, the ripple within the ±15° sector coverage was 2.95 dB, and the margin at 30° was 1 dB.

Figure 10:
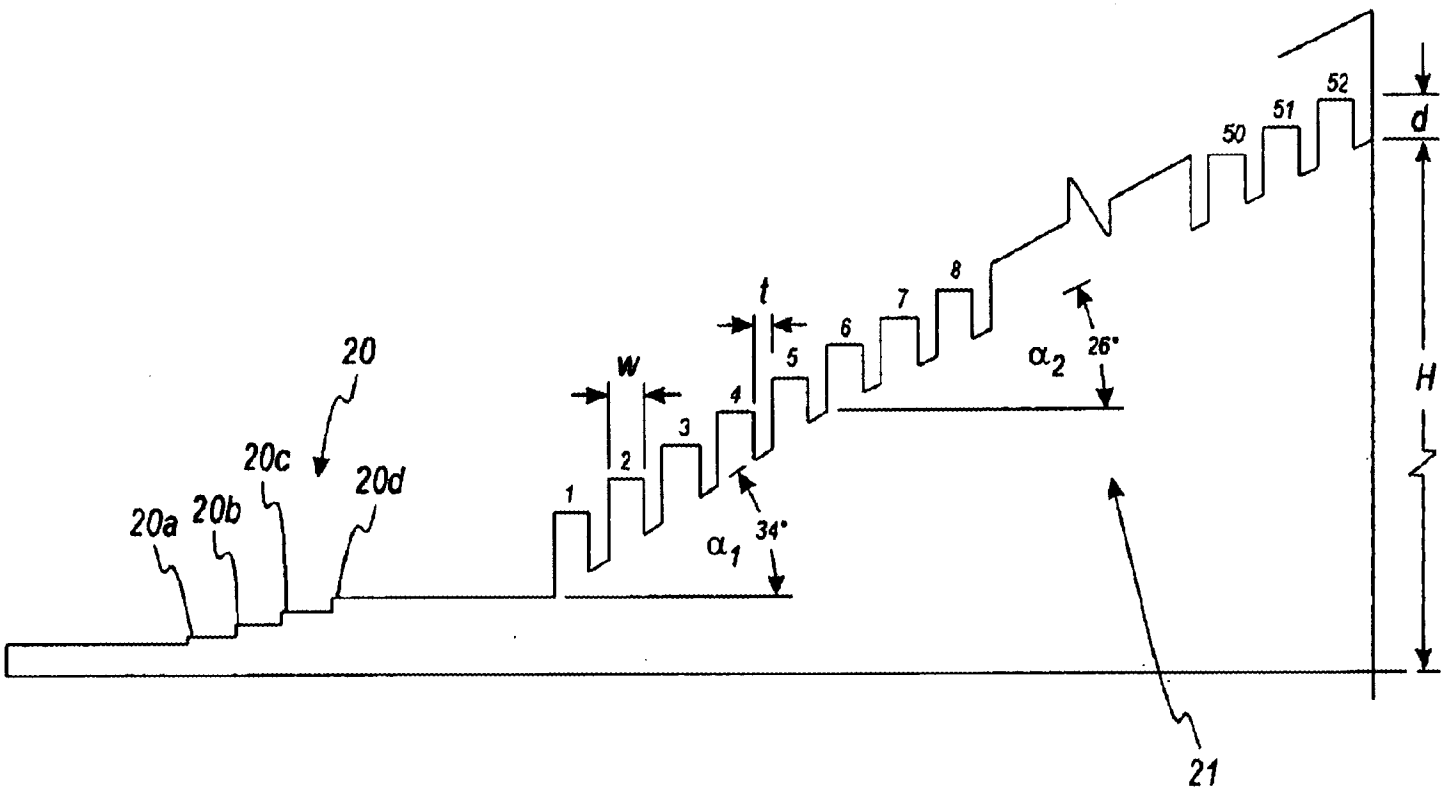
FIG. 10 is a longitudinal profile of the interior surface of one of a symmetrical pair of opposed walls in a modified pyramidal horn antenna embodying the present invention.
Figure 11A:
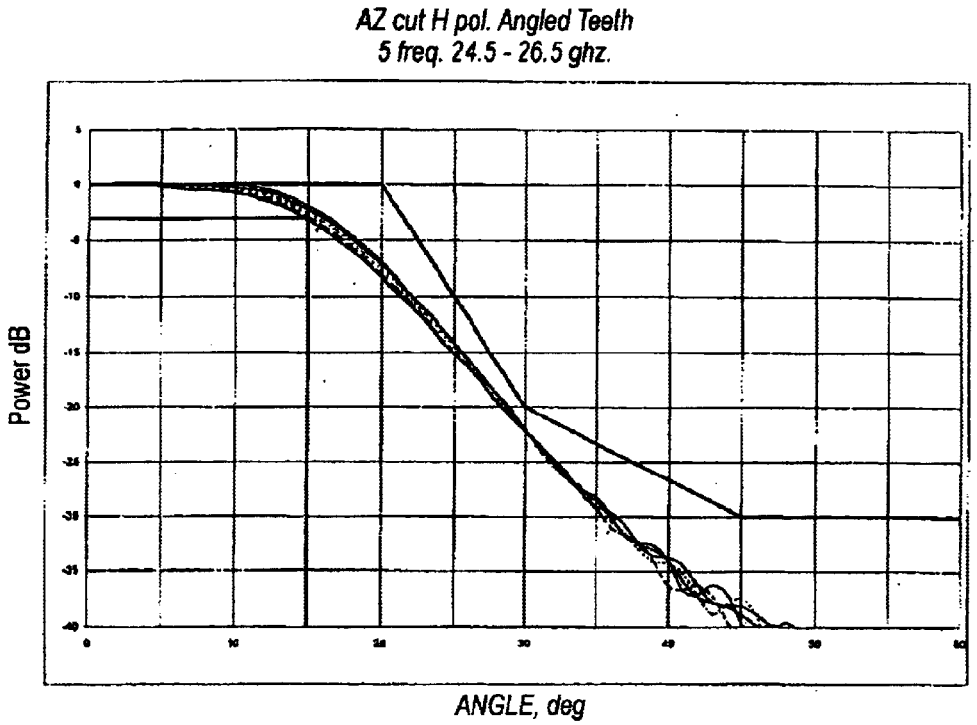
FIGS. 11*a* and 11*b* are predicted azimuth-plane and elevation-plane patterns, respectively, produced by the horn antenna of FIG. 10.
Figure 11B:
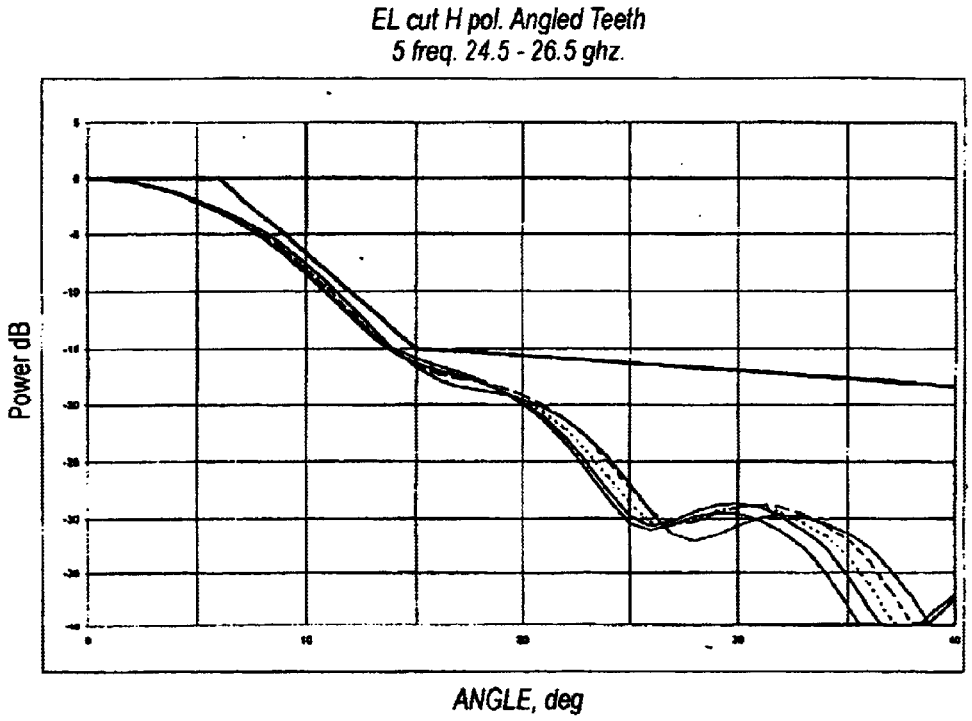
Figure 11C:
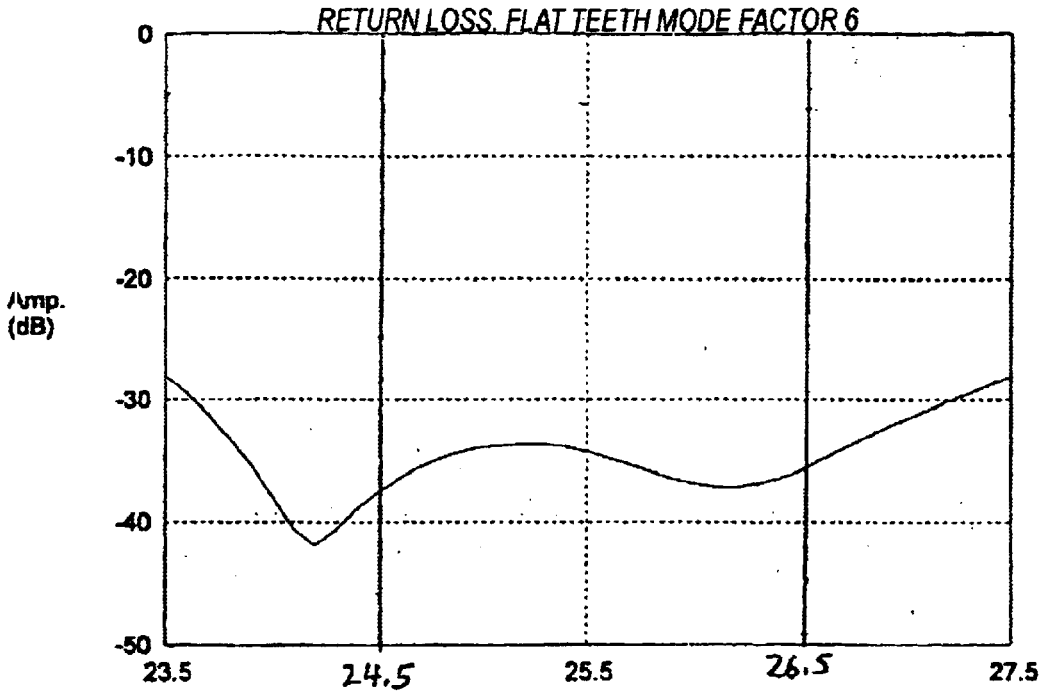
FIGS. 11*c* and 11*d* are predicted return loss responses for the horns of FIG. 8 and FIG. 10, respectively.
Figure 11D:
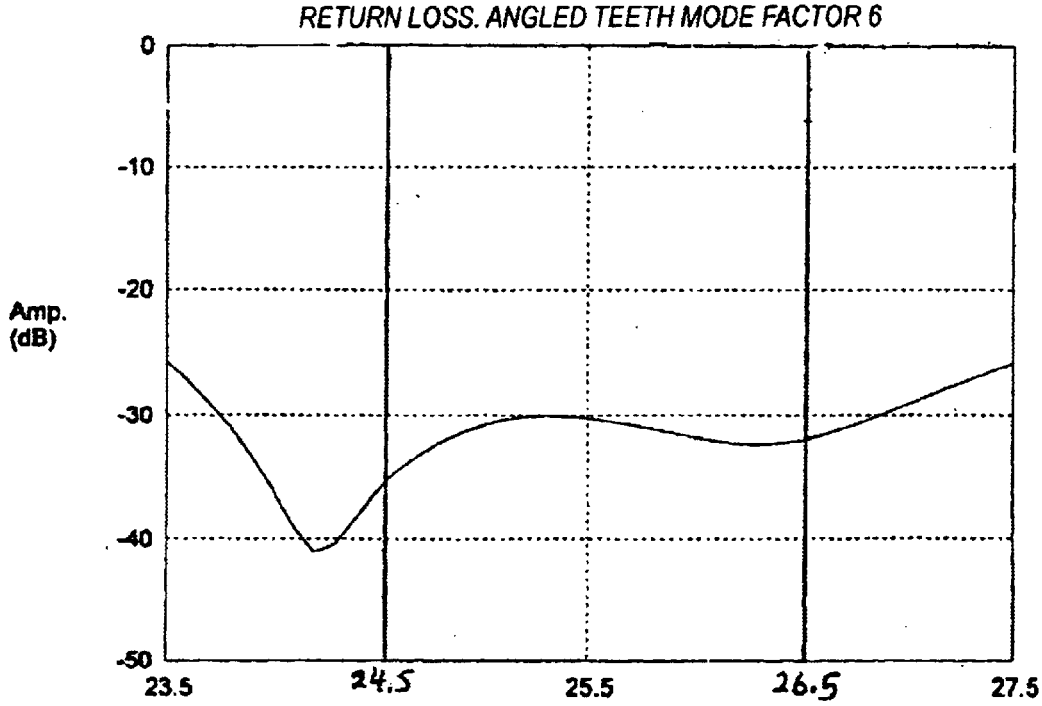

FIG. 10 is a longitudinal profile of the interior surface of one of a symmetrical pair of opposed walls in a pyramidal horn antenna used to produce the azimuth-plane and elevation-plane patterns in FIGS. 11*a*–11*b*. The shape is the same as that of the horn of FIG. 8, except that the troughs of the corrugations have angled bottom surfaces, parallel to the tips of the crests rather than the horn axis. The dimensions are the same as in the horn of FIG. 8 except for the following differences in the dimensions of the corrugations:

| Corrugation No. | Depth d | Trough Width w | Crest Width t |
|---|---|---|---|
| 1 | 0.23 | 0.10 | 0.05 |
| 2 | 0.22 | 0.10 | 0.05 |
| 3 | 0.21 | 0.10 | 0.05 |
| 4 | 0.20 | 0.10 | 0.05 |
| 5 | 0.19 | 0.10 | 0.05 |
| 6 through n | 0.18 | 0.10 | 0.05 |

The return loss was 30 dB, the ripple within the ±15° sector coverage was 3.20 dB, and the margin at 30° was 2 dB.

To produce an azimuthal-plane pattern that is more flat across the width of the specified sector, the feed end of the corrugated horn may be designed to produce dual modes, by generating a higher-order mode. One such mode-generating method is to make a change in the horn's half angle at a sufficiently large transverse dimension of the horn. The introduction of this angle change causes the desired higher-order mode to be generated, which in turn produces a flatter pattern across the desired beamwidth. This is seen in FIG. 8 where the horn half angle changes from $\alpha_1=34°$ to $\alpha_2=26°$. It is this change in flare angle which generates the modes required to produce the flat-top azimuth patterns described in FIGS. 9*a* and 11*a*.

In applications requiring a single antenna for orthogonally polarized signals, all four walls of the pyramidal horn are corrugated and the input waveguide is, typically, a square waveguide to which is attached an orthomode coupler.

The corrugated walls described above may be replaced with absorber-lined walls. Absorber is a well known material used in microwave equipment, and typically comprises a foamed polymeric material impregnated with conductive particles such as graphite. The absorber lining is bonded to the inside surfaces of the same walls that are corrugated in the embodiments described above, in place of the corrugations. The exposed surface of the absorber lining may be either smooth or convoluted, but in small-sized horns it is generally desirable to use smooth-surfaced absorber to minimize blockage. If desired, the metal walls of the horn may be formed with recesses for receiving the absorber lining and thereby reducing or eliminating blockage by the absorber.

We claim:

1. An antenna for use in a sectorized cellular communication system, said antenna comprising a wide-flare pyramidal horn having two pairs of opposed flared walls, at least one of said two pairs of opposed walls having corrupted interior surfaces, the length of said horn and the flare angle of said walls having said corrugated interior surfaces being dimensioned to produce a ratio $\Delta_e/\lambda$ greater than 1.5, where $\Delta_e=[a/2/\lambda]\tan(\alpha_e/2)$ is the spherical-wave error of said horn, $\lambda$ is the free space wavelength of the microwave signals to be transmitted by said antenna, a is the aperture width and $\alpha_e$ is the horizontal half-angle of the horn.

2. The antenna of claim 1 wherein said ratio $\Delta_e/\lambda$ is greater than 2.

3. The antenna of claim 1 wherein said ratio $\Delta_e/\lambda$ is greater than 2.5.

4. The antenna of claim 1 wherein the E-plane walls of said horn are corrugated.

5. The antenna of claim 1 wherein the H-plane walls of said horn are corrugated.

6. The antenna of claim 1 wherein both the E-plane walls and the H-plane walls of said horn are corrugated.

7. The antenna of claim 1 wherein said corrugations are substantially perpendicular to the flared walls of the horn in which they are formed.

8. The antenna of claim 1 wherein said corrugations are substantially perpendicular to the horn axis.

9. The antenna of claim 1 which includes a rectangular waveguide connected to the small end of said horn.

10. The antenna of claim 1 wherein said horn is dimensioned and shaped to produce specified azimuth and elevation beam widths and patterns, the azimuthal pattern having a half-power beam width that is substantially as wide as the azimuthal width of the selected sector and dropping sharply at both azimuthal edges of that sector.

11. The antenna of claim 1 wherein the elevation-plane pattern is substantially free of nulls within the specified ground range.

12. The antenna of claim 1 wherein said flared walls being dimensioned to produce a ration $\Delta_h/\lambda$ greater than 0.25, where $\Delta_h$=[b/(2/λ)] tan ($\alpha_h$/2) is the spherical-wave error of said horn in the elevation plane, λ is the free space wavelength of the microwave signals to be transmitted by said antenna, b is the aperture height and $\alpha_h$ is the elevation half angle of the horn.

13. The antenna of claim 1 wherein said horn is a multi-mode horn.

14. An antenna for use in a sectorized cellular communication system, said antenna comprising a wide-flare pyramidal horn having two pairs of opposed flared side walls, at least one of said two pairs of opposed walls having absorber-lined interior surfaces, the length of said horn and the flare angle of said walls having said absorber-lined interior surfaces being selected to produce a ratio $\Delta_e/\lambda$ greater than 1.5, where $\Delta_e$=[a/2/λ] tan ($\alpha_e$/2) is the spherical-wave error of said horn, λis the free space wavelength of the microwave signals to be transmitted by said antenna, a is the aperture width and $\alpha_e$ is the horizontal half-angle of the horn.

15. A sectorized cellular communication system comprising multiple adjoining cells each of which has a cell site containing an antenna for transmitting signals to, and receiving signals from, users within that cell, at least some of said antennas comprising a wide-flare pyramidal horn having two pairs of opposed flared walls, at least one of said two pairs of opposed walls having corrugated interior surfaces, the length of said horn and the flare angle of said walls having said corrugated interior surfaces being dimensioned to produce a ratio $\Delta_e/\lambda$ greater than 1.5, where $\Delta_e$=[a/2/λ] tan ($\alpha_e$/2) is the spherical-wave error of said horn, λ is the free space wavelength of the microwave signals to be transmitted by said antenna, a is the aperture width and $\alpha_e$ is the horizontal half-angle of the horn.

16. The microwave antenna of claim 15 wherein said ratio $\Delta_e/\lambda$ is greater than 2.

17. The microwave antenna of claim 15 wherein said ratio $\Delta_e/\lambda$ is greater than 2.5.

18. The microwave antenna of claim 15 wherein the E-plane walls of said horn are corrugated.

19. The microwave antenna of claim 15 wherein the H-plane walls of said horn are corrugated.

20. The antenna of claim 15 wherein both the E-plane walls and the H-plane walls of said horn are corrugated.

21. The microwave antenna of claim 15 wherein said corrugations are substantially perpendicular to the flared walls of the horn in which they are formed.

22. The microwave antenna of claim 15 wherein said corrugations are substantially perpendicular to the horn axis.

23. The microwave antenna of claim 15 which includes a rectangular waveguide connected to the small end of said horn.

24. The sectorized cellular communication system of claim 15 wherein said horn is dimensioned and shaped to produce specified azimuth and elevation beam widths and patterns, the azimuthal pattern having a half-power beam width that is substantially as wide as the azimuthal width of the selected sector and dropping sharply at both azimuthal edges of that sector.

25. The sectorized cellular communication system of claim 15 wherein the elevation-plane pattern is substantially free of nulls within the specified ground range.

26. The sectorized cellular communication system of claim 15 wherein said flared walls being dimensioned to produce a ratio $\Delta_h/\lambda$ greater than 0.25, where $\Delta_h$=[b/(2/λ)] tan ($\Delta_h$/2) is the spherical-wave error of said horn in the elevation plane, λ is the free space wavelength of the microwave signals to be transmitted by said antenna, b is the aperture height and $\alpha_h$ is the elevation half angle of the horn.

27. The microwave antenna of claim 15 wherein said horn is a multi-mode horn.

28. A sectorized cellular communication system comprising multiple adjoining cells each of which has a cell site containing an antenna for transmitting signals to, and receiving signals from, users within that cell, at least some of said antennas comprising a wide-flare pyramidal horn having two pairs of opposed flared side walls, at least one of said two pairs of opposed walls having absorber-lined interior surfaces, the length of said horn and the flare angle of said walls having said absorber-lined interior surfaces being selected to produce a ratio $\Delta_e/\lambda$ greater than 1.5, where $\Delta_e$[a/2/λ] tan ($\alpha_e$/2) is the spherical-wave error of said horn, λ is the free space wavelength of the microwave signals to be transmitted by said antenna, a is the aperture width and $\alpha_e$ is the horizontal half-angle of the horn.

29. A method of designing a wide-flare pyramidal horn for use in a sectorized cellular communication system, said horn having at least one pair of opposed walls having corrugated interior surfaces, said method comprising selecting a length for said horn and a flare angle for said walls having said corrugated interior surfaces, being dimensioned to produce a ratio $\Delta_e/\lambda$ greater than 1.5, where $\Delta_e$=[a/2/λ] tan ($\alpha_e$/2) is the spherical-wave error of said horn, λ is the free space wavelength of the microwave signals to be transmitted by said antenna, a is the aperture width and $\alpha_e$ is the horizontal half-angle of the horn.

30. The method of claim 29 wherein said length and flare angle are selected to satisfy specified azimuth and elevation radiation patterns within a specified sector.

31. The method of claim 29 wherein said specified azimuthal pattern has a half-power beam width that is substantially as wide as the azimuthal width of the selected sector and dropping sharply at both azimuthal edges of that sector.

32. The method of claim 29 wherein said ratio $\Delta_e/\lambda$ is greater than 2.

33. The method of claim 29 wherein said ratio $\Delta_e/\lambda$ is greater than 2.5.

34. The method of claim 29 wherein the E-plane walls of said horn are corrugated.

35. The method of claim 29 wherein the H-plane walls of said horn are corrugated.

36. The antenna of claim 29 wherein both the E-plane walls and the H-plane walls of said horn are corrugated.

37. The method of claim 29 wherein said corrugations are substantially perpendicular to the flared walls of the horn in which they are formed.

38. The method of claim 29 wherein said corrugations are substantially perpendicular to the horn axis.

39. The method of claim 29 wherein a rectangular waveguide is connected to the small end of said horn.

40. The method of claim 29 wherein the elevation-plane pattern is substantially free of nulls within the specified ground range.

41. The method of claim 29 wherein said flared walls being dimensioned to produce a ratio $\Delta_h/\lambda$ greater than 0.25, where $\Delta_h=[b/(2/\lambda)]\tan(\alpha_h/2)$ is the spherical-wave error of said horn in the elevation plane, $\lambda$ is the free space wavelength of the microwave signals to be transmitted by said antenna, b is the aperture height and $\alpha_h$ is the elevation half angle of the horn.

42. The method of claim 29 wherein said horn is a multi-mode horn.

43. A method of designing a wide-flare pyramidal horn for use in a sectorized cellular communication system, said horn having at least one pair of opposed walls having corrugated interior surfaces, said method comprising selecting a length for said horn and a flare angle for said walls having said corrugated interior surfaces being dimensioned to produce a ratio $\Delta_e/\lambda$ greater than 1.5, where $\Delta_e=[a/2/\lambda]\tan(\alpha_e/2)$ is the spherical-wave error of said horn, $\lambda$ is the free space wavelength of the microwave signals to b transmitted by said antenna, a is the aperture width and $\alpha_e$ is the horizontal half-angle f the horn.

44. The antenna of claim 9 and further, wherein said rectangular waveguide has stepped interior surfaces at the small end of said pyramidal horn.

45. The microwave antenna of claim 23 and further, wherein said rectangular waveguide has stepped interior surfaces at the small end of said pyramidal horn.

46. The method of claim 39 and further, wherein said rectangular wavequide has stepped interior surfaces at the small end of said pyramidal horn.

* * * * *